US007584876B2

(12) United States Patent
Waitlevertch et al.

(10) Patent No.: US 7,584,876 B2
(45) Date of Patent: Sep. 8, 2009

(54) WIRE INJECTOR APPARATUS

(75) Inventors: Joseph R. Waitlevertch, Butler, PA (US); Ronald L. Downard, Elkton, OH (US); Frank A. Sokolowski, Monroeville, PA (US)

(73) Assignee: ESM Group Inc., Amherst, NY (US)

( * ) Notice: Subject to any disclaimer, the term of this patent is extended or adjusted under 35 U.S.C. 154(b) by 392 days.

(21) Appl. No.: 11/505,959

(22) Filed: Aug. 17, 2006

(65) Prior Publication Data

US 2008/0041909 A1 Feb. 21, 2008

(51) Int. Cl.
*B65H 51/28* (2006.01)

(52) U.S. Cl. ..... 226/109; 226/110; 226/177; 226/187

(58) Field of Classification Search ..... 226/108, 226/109, 110, 115, 155, 176, 177, 186, 187, 226/188, 174, 181; 242/564.4, 564.3
See application file for complete search history.

(56) References Cited

U.S. PATENT DOCUMENTS 4,879,934 A * 11/1989 Adlon et al. ..... 83/76.9

* cited by examiner

*Primary Examiner*—John Q. Nguyen
*Assistant Examiner*—William E Dondero
(74) *Attorney, Agent, or Firm*—Hodgson Russ LLP

(57) ABSTRACT

A wire injector apparatus for impelling wire or injecting wire is provided. The wire injector has a motorized pulley system connected to a drive wheels for moving the wire laterally through the apparatus. Further, upper and lower idler wheels are arranged about the drive wheels to engage the wire with the drive wheels. A clamp connects the upper idler wheels to the lower idler wheels such that a single actuated lever can control and position multiple upper and/or lower idler wheels. Wire line paths for moving the wire are provided intermediate to the drive wheels and the idler wheels. The arrangement of the components of the wire injector allows for customizing the number of idler wheels and drive wheels to, in turn, provide any number of wire line paths for impelling or injecting any number of wires.

18 Claims, 12 Drawing Sheets

WIRE INJECTOR APPARATUS

BACKGROUND

In many industries, such as the steel industry, it is necessary to precisely inject or feed a length of metal tubing, wire or the like for use in manufacturing. Such wire or tubing is fed through a machine to measure it to a desired length. One preferred type of wire or tubing is known as cored wire, which can be formed from many different types of materials. The cored wire industry has become a widely accepted solution for past problems involved in adding components to metal, such as nozzle clogging in continuous casting steel plants that frequently occurred when producing alloyed steels.

Ordinarily, metal, such as steel, is produced with the addition of one or more metal alloys so that the metal may exhibit certain characteristics, such as machinability, hardness, strength, durability, elasticity, brittleness or corrosiveness. For example, aluminum steel exhibits a higher tensile strength and is smoother than non-alloyed steel. The addition of cored metal wire is a popular way to produce alloyed steels due to its applicability to a diverse number of alloys and ability to exhibit certain desired properties.

Cored wire and solid wire are generally formed from well-compacted metal powder that is uniform in weight along the length of a wire. As a result, the length of the cored or solid wire corresponds to an amount of compacted powder. Therefore, a particular amount of metal powder required for the manufacture of a particular alloy can be easily measured and added to steel based on the length of the metal wire.

Manufacturers of steel alloys require large amounts of cored wire. This demand for cored wire, together with the popularity of cored wire in producing steel alloys, has led to a mass production of cored wire. Accordingly, manufacturers of cored wire produce and package long lengths of cored wire that are typically caged or reeled for ease in transportation and distribution. However, working with caged or reeled cored wire when producing metal alloys can be cumbersome and extremely burdensome. Further, in order to produce steel with accurate percentages of alloys, precise lengths of cored metal alloy wires must be added to liquid metal, preferably into a ladle prior to casting.

As a result, a need has grown for a machine or apparatus capable of feeding or injecting the caged or reeled cored wire into the ladle. In addition, a need exists for a machine to precisely measure cored wire to a given length for the addition of cored wire into a ladle.

While cored wire injectors are known, the present state of technology of is such that cored wire injectors are expensive and difficult to use and repair. For example, known wire injectors require two or more pneumatic actuators for each cored wire path fed by the injector. Known wire injectors require customized motors that are expensive to produce and to repair. The customized motors are typically located between core4d wire paths making the servicing of customized motors more expensive and time consuming. In addition, the vast number of parts in known wire injectors increases the frequency of failures and reduces the service life of the wire injector. Accordingly, such known wire injectors are costly to produce and operate.

As a result, a need exists for a wire injector that is less costly to manufacture, service, and operate. A need also exists for a wire injector capable of operating without customized motors. A further need exists for a wire injector having one or more motors positioned in a location operable for servicing. A need also exists for a wire injector requiring fewer parts for feeding cored wire through the wire injector.

SUMMARY OF THE INVENTION

In an embodiment of the present invention, a wire injector apparatus having a first wire path and a second wire path adjacent to said first wire path is provided. The wire injector has a drive wheel impelling a wire in said first wire path or said second wire path. Further, the wire injector has a first idler wheel engagable with said wire in said first wire path. Still further, the wire injector has a second idler wheel engagable with said wire in said second wire line path. Moreover, the wire injector has an actuator engaging said first idler wheel and said second idler wheel, said actuator engaging at least one of said first idler wheel with said first wire path and said second idler wheel with said second wire path or disengaging both said first idler wheel and said second idler wheel.

In another embodiment of the present invention, a motorized wire injector for impelling a wire is provided. The motorized wire injector has a motorized pulley assembly having a pulley and a belt whereby said pulley rotatably engages said belt and a drive shaft actuated by said pulley assembly. Further, the motorized wire injector has a plurality of drive wheels secured to said drive shaft wherein said drive shaft rotates said drive wheels and at least one of said drive wheels impels said wire. Still further, the motorized wire injector has a plurality of idler wheels pivotally engaging said wire to said drive wheels.

In yet another embodiment of the present invention, a metal wire injector for providing at least one length of metal wire is provided. The metal wire injector has motor and a drive wheel engaged to said motor, wherein operation of said motor rotates said drive wheel and said drive wheel impels said metal wire. Further, the metal wire injector has a plurality of clamps, each of said clamps includes an upper idler wheel and a lower idler wheel positioned at opposing ends of said clamps. Still further, the metal wire injector has a pneumatic actuator connected to said clamps to move said clamps to a first position where said upper idler wheels engage said metal wire, a second position where said lower idlers wheel engage said metal wire, and a third position where said upper idler wheels and said lower idler wheels do not engage said metal wire.

BRIEF DESCRIPTION OF THE DRAWINGS

The invention may take physical form in certain parts and arrangements of parts with several embodiments being described in detail in this specification and illustrated in the accompanying drawings wherein.

DETAILED DESCRIPTION OF THE PREFERRED EMBODIMENTS

Without limiting scope of the present invention, the preferred embodiments of the invention are described with regard to implementation as a wire injector. However, it is understood that the improved wire injector of the present invention could be used in any manner known or readily ascertainable to one of ordinary skill in the art, such as for measuring, cutting, injecting and/or clamping numerous materials or substances as known to one of ordinary skill in the art.

Figure 1A:
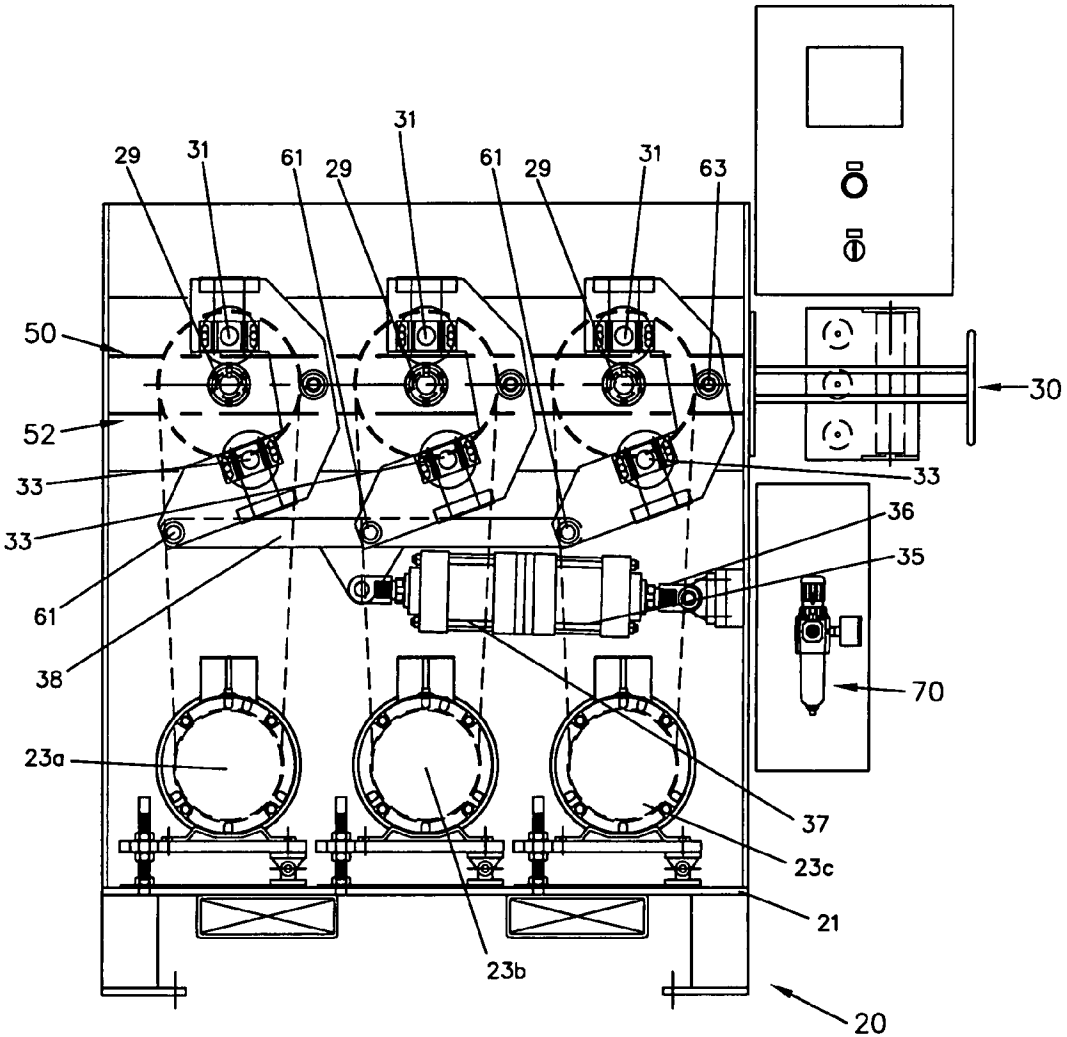
FIG. 1A is a side perspective view of a wire injector having two wire paths in an embodiment of the present invention.
Figure 1B:
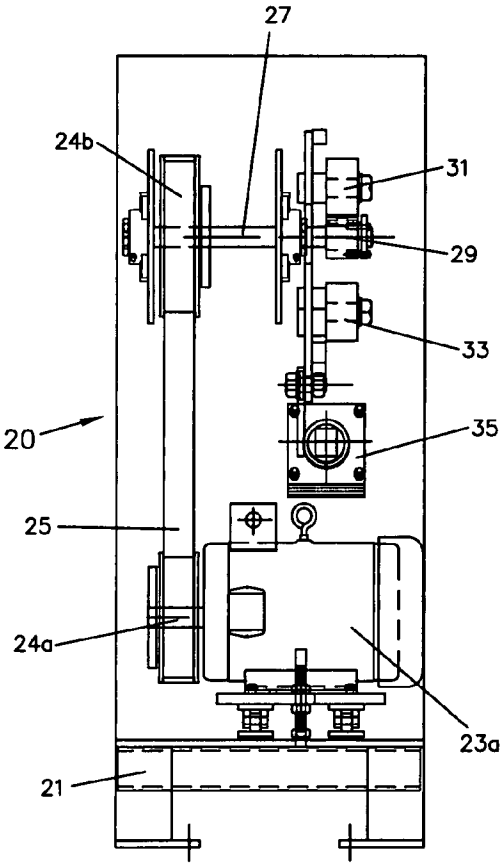
FIG. 1B is a front perspective view of FIG. 1A.

Reference is now made to the drawings. FIGS. 1A and 1B illustrates a side perspective view of a wire injector apparatus 20 The wire injector 20 can be used to feed or to inject a length of wire, such as, metal wire, for example, cored metal wire or solid metal wire into a steel ladle prior to casting. In the embodiment shown in FIGS. 1A and 1B, the wire injector 20 is capable of clamping or impelling two metal wires; hence the wire injector 20 is a two wire path wire injector. While the wire injector 20 shown in FIG. 1A provides for feeding two metal wire reels through the respective wire paths for injection into the steel ladle, it is contemplated that the wire injector of the present invention can have any number of wire paths depending on a desired number of metal wires to be added.

As generally illustrated, the wire injector 20 includes motors 23*a-c* operably mounted to a base 21. Each of the motors 23*a-c* provides input power to a corresponding drive shaft 27 as illustrated in FIG. 1B. In an exemplary embodiment, each of the motors 23*a-c* rotates a first pulley assembly 24*a* having a belt 25, which engages a second pulley assembly 24*b* to rotate one of the drive shafts 27. Sizes of the first pulley 24*a* and the second pulley assembly 24*b* may be adjusted to correspond to a desired output speed of the drive shaft 27. While FIG. 1B shows one drive shaft 27 in conjunction with motor 23*a*, motors 23*b* and 23*c* each also include a drive shaft (not shown), such as drive shaft 27 as well as the first pulley assembly 24*a*, the second pulley assembly 24*b* and the belt 25.

Rotation of each drive shaft 27 translates into rotation of each drive wheel 29 for impelling, for example, cored metal wire laterally through the wire injector 20. The metal wire is fed or input into the wire injector 20 at input 30. Each of the motors 23*a-c* provides torque for rotating the drive wheels 29 that move the metal wire laterally through the wire injector 20. In a preferred embodiment, the torque or input power of each of the motors 23*a-c* is transferred to the drive shaft 27 from the second pulley assembly 24*b* and the first pulley assembly 24*a*.

Figure 2B:
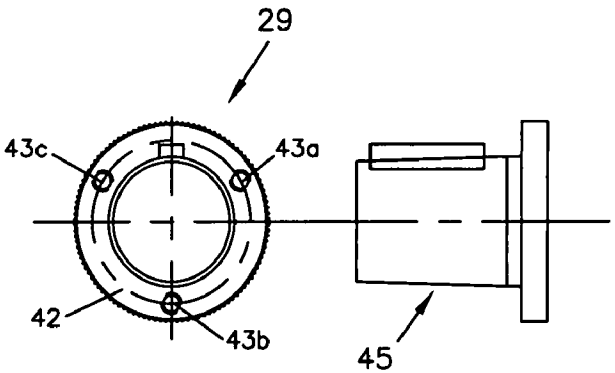
FIGS. 2A, 2B, 2C and 2D are side views of an inside face, outside face, and assembled view of a drive wheel.
Figure 2C:
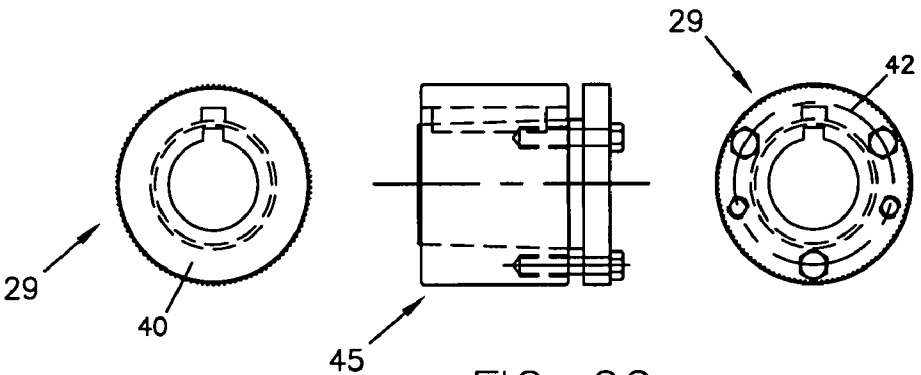
Figure 2A:
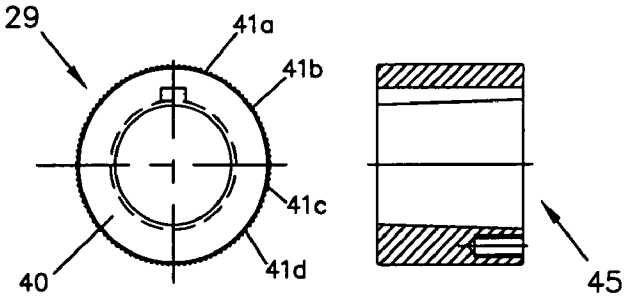
Figure 2D:
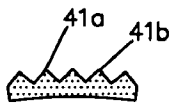
Figure 3A:
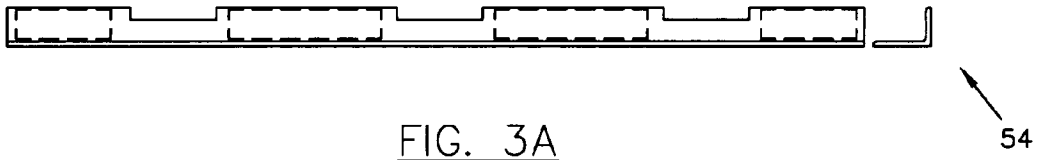
FIGS. 3A and 3B are a side perspective view and a top perspective view, respectively, of an interior of a wire channel.
Figure 3B:
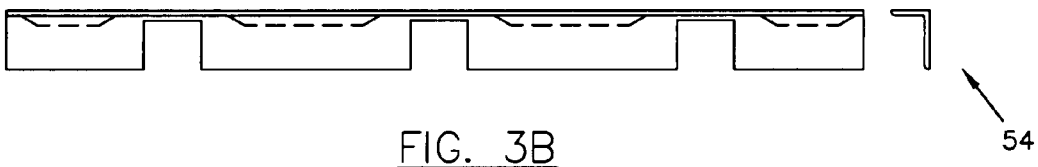
Figure 3C:
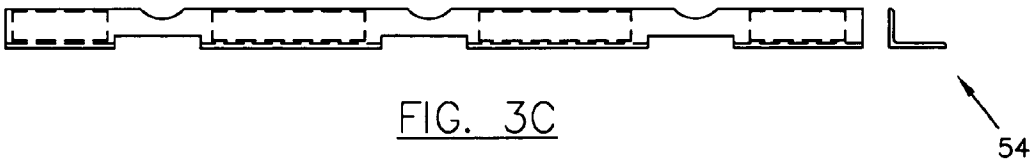
FIGS. 3C and 3D are a side perspective view and a top perspective view, respectively, of an exterior of a wire channel.
Figure 3D:
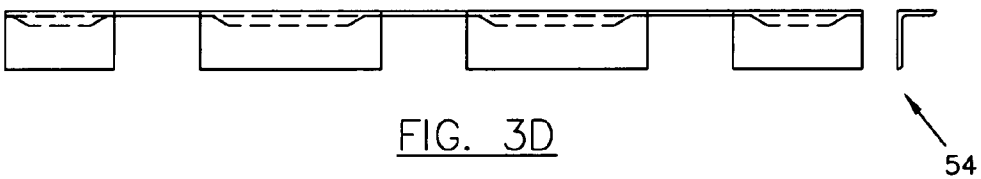

An embodiment of the drive wheel 29 is illustrated in FIGS. 2A-2C. Each of the drive wheels 29 comprises an inside wall 40 (see FIG. 2A) and an outside wall 42 (see FIG. 2B). A plurality of teeth 41*a-d* are formed on the drive wheels 29 between the inside and outside walls 40 and 42. In a preferred embodiment, the teeth 41 *a-d* are formed at a forty-five degree angle with respect to a center of the drive wheel 29 as shown in FIG. 2D. The outside face 42 of the drive wheel 29 has apertures 43*a-c* for attachment to the drive shaft 27. As an example, the drive wheel 29 may be bolted to a bushing 45 attached to the drive shaft 27 through the apertures 43*a-c*.

Referring again to FIGS. 1A and 1B, the wire injector 20 includes upper idler wheels 31 and lower idler wheels 33 for engaging the metal wire with the drive wheels 29. In a preferred embodiment, either the upper idler wheels 31 or the lower idler wheels 33 engage the metal wire to the drive wheels 29 at a given time. However, the present invention should not be limited to such a preferred embodiment, as it is clearly contemplated that both the upper idler wheels 31 and the lower idler wheels 33 could simultaneously engage drive wheels 29.

Interposed between the drive wheels 29 and the upper idler wheels 31 is a top wire line path 50 whereby the metal wire moves through the wire injector 20. A bottom wire line path 52 is interposed between the drive wheels 29 and the lower idler wheels 33. The metal wire may move along one of the wire line paths 50, 52 and within a channel 54. FIGS. 3A-3D illustrate an embodiment of a channel 54. In the embodiment shown, the channel 54 is tubular with openings (indicated by the dotted lines) for exposing the metal wire to the idler wheels 31, 33.

The upper idler wheels 31 and the lower idler wheels 33 alternate in an engaged position whereby the drive wheels 29 or the metal wire is engaged with the upper or lower idler wheels 31, 33. For example, FIG. 1A illustrates the upper idler wheels 31 in an engaged position and the lower idler wheel 33 in an unengaged position. Further, the upper idler wheels 31 and the lower idler wheels 33 can move to a neutral position such that metal wire and/or the drive wheels 29 are not engaged with either the upper idler wheels 31 or the lower idler wheels 33. In a neutral position, the metal wire does not engage the drive wheels 29, and, as a result, the metal wire does not move through one of the wire line paths 50, 52.

At the engaged position the upper or lower idler wheels 31, 33 contact or engage the metal wire with the drive wheels 29. The upper or lower idler wheels 31, 33 act to clamp or force the metal wire to engage the drive wheels 29 and thereby to impel the metal wire laterally through one of the channels 54 of the wire injector 20. In a preferred embodiment, the upper idler wheels 31 are at the engaged position when the lower idler wheels 33 are at the disengaged position. Accordingly, in an exemplary embodiment, metal wire is only passing through one of the wire paths 50, 52 at a given time. To this end, an operator can safely operate the wire injector 20 by attentiveness to only one metal wire exiting the wire injector 20. Of course, the wire injector 20 is contemplated for engaging or disengaging the upper idler wheels 31 and the lower idler wheels 33 simultaneously.

As the metal wire passes through one of the wire line paths 50, 52, the metal wire tends to vibrate, twist or otherwise move in an unwanted direction. As a result, upper idler wheels 31 or lower idler wheels 33 at the engaged position are utilized to guide the metal wire during movement through the wire injector 20. In a preferred embodiment, the idler wheels 31, 33 are circular in shape to rotatably engage the metal wire.

Figure 4C:
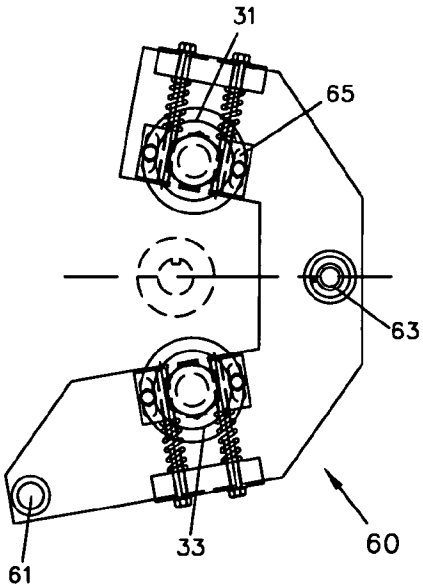
FIG. 4C is a side perspective view of a clamp that is not engaging the top wire line path or the bottom wire line path.
Figure 4B:
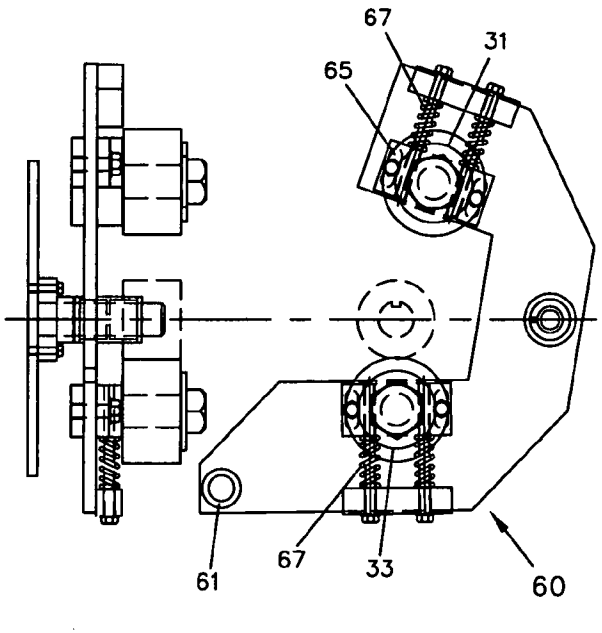
FIG. 4B is a side perspective view of a clamp engaging a bottom wire line path.
Figure 4A:
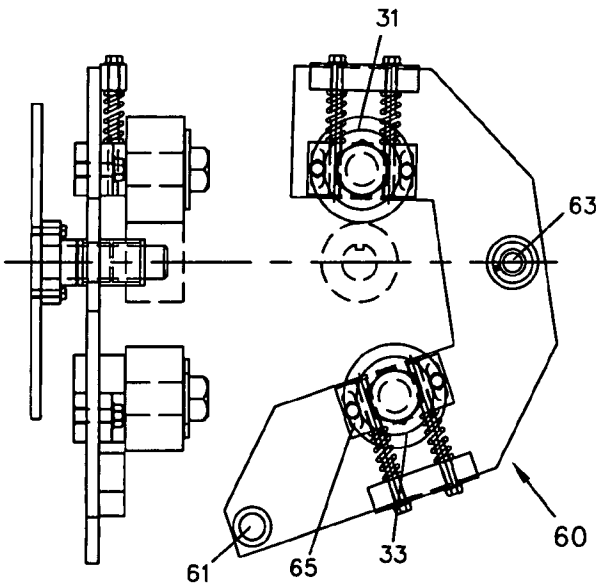
FIG. 4A is a side perspective view of a clamp engaging a top wire line path.

A clamp 60 connects the upper idler wheels 31 to the lower idler wheels 33 about the drive wheels 29. FIGS. 4A-4C illustrate side perspective views of the clamp 60 in the engaged position with the top wire line path 50, in the engaged position with the bottom wire line path 52 and the neutral position, respectively. Specifically, FIG. 4A illustrates the upper idler wheel 31 at the engaged position and the lower idler wheel 33 at the disengaged position. FIG. 4B illustrates the upper idler wheel 31 at the disengaged position and the lower idler wheel 33 at the engaged position. Furthermore, as illustrated in FIG. 4C, the upper and lower idler wheels 31, 33 are at a neutral position that is intermediate to the engaged position and the disengaged position. The neutral position may be utilized to prepare the wire injector 20 for operation, such as, to connect the metal wire from a reel into one of the clamps 60. The neutral position may also be utilized as a safety position or a shut off position when the wire injector 20 is not in operation.

Further, the upper idler wheels 31 and the lower idler wheels 33 are positioned at opposing ends of the clamp 60. In a preferred embodiment, the clamp 60 is generally C-shaped such that the drive shaft 37 is positionable intermediate to the upper idler wheels 31 and the lower idler wheels 33. The clamp 60 pivots about a pivot 63 to move the upper and lower idler wheels 31, 33 from the engaged position to the disengaged position. As illustrated in FIG. 1A, a lever 38 secures to the clamps 60 at point 61 to pivot each of the clamps 60 about the pivot 63.

The upper and lower idler wheels 31, 33 are secured within a slot 65 of the clamp 60 so that the idler wheels 31, 33 are movable vertically relative to the drive wheel 29. To this end, the idler wheels 31, 33 can accommodate metal wire having various thicknesses without further alignment or adjustment. In addition, the upper and lower idler wheels 31, 33 are movable within the slot 65 to absorb vibrations or vertical movement of the metal wire, which may occur during operation. FIG. 4B illustrates springs 67 independently tensioning each of the idler wheels 31, 33. The springs 67 absorb vibrations caused by the metal wire moving through the wire injector 20. Still further, providing a corresponding slot 65 and spring 67 to opposing sides of the upper and lower idler wheels 31, 33 allows independent positioning of each side of the idler wheels 31, 33. In other words, the upper and lower idler wheels 31, 33 are positionable at a range of angles within the slot 65.

An actuator 35 controls movement of the upper idler wheels 31 and the lower idler wheels 33 along a range of positions from the engaged position to the disengaged position. Specifically, in a preferred embodiment, the actuator 35 engages the lever 38 to move each of the clamps 60. As a result, in an exemplary embodiment, a single actuator 35 engages the clamps 60 and, in turn, the engagement of the upper idler wheels 31 and the lower idler wheels 33 to the top and bottom wire paths 50, 52. Therefore, in such an embodiment, the actuator 35 controls the position of each of the upper idler wheels 31 and the lower idler wheels 33.

As illustrated in FIG. 1A, the actuator 35 includes a pneumatically controlled piston 36 and a telescopically engaging housing 37. The piston 36 and the housing 37 are positioned between the lever 38 and the base 21. In operation, the piston 36 telescopically extends from the housing 37 to engage the lever 38. In a preferred embodiment, a pneumatic cylinder 70, such as, a pneumatic air valve, controls the piston 36.

Figure 5:
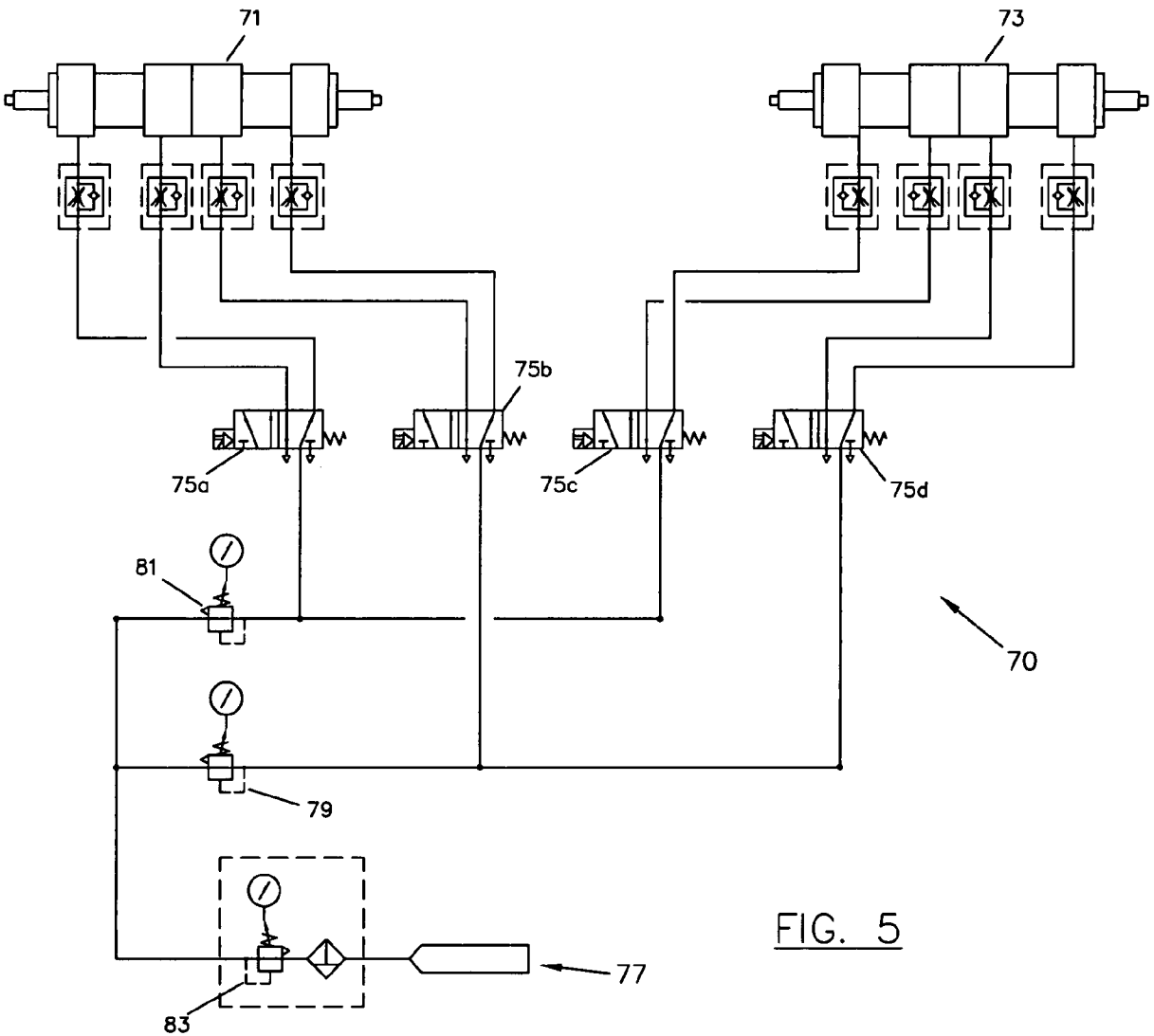
FIG. 5 is a schematic for the operation of a pneumatic actuator.

FIG. 5 illustrates a schematic of the regulation for the pneumatic cylinder 70 in an embodiment of the present invention. A first cylinder 71 and a second cylinder 73 control the clamps 60 for at least two wire fed lines (not shown). Spool valves 75*a-d* control airflow to and from the cylinders 71, 73. Air is supplied via input 77 and is regulated by a bottom clamp pressure regulator 79 and a top clamp pressure regulator 81 before flowing to the spool valves 75*a-d*. In an embodiment, a supply regulator 83 is positioned intermediate to the input 77 and the bottom clamp pressure regulator 79 and/or the top clamp pressure regulator 81.

Figure 6A:
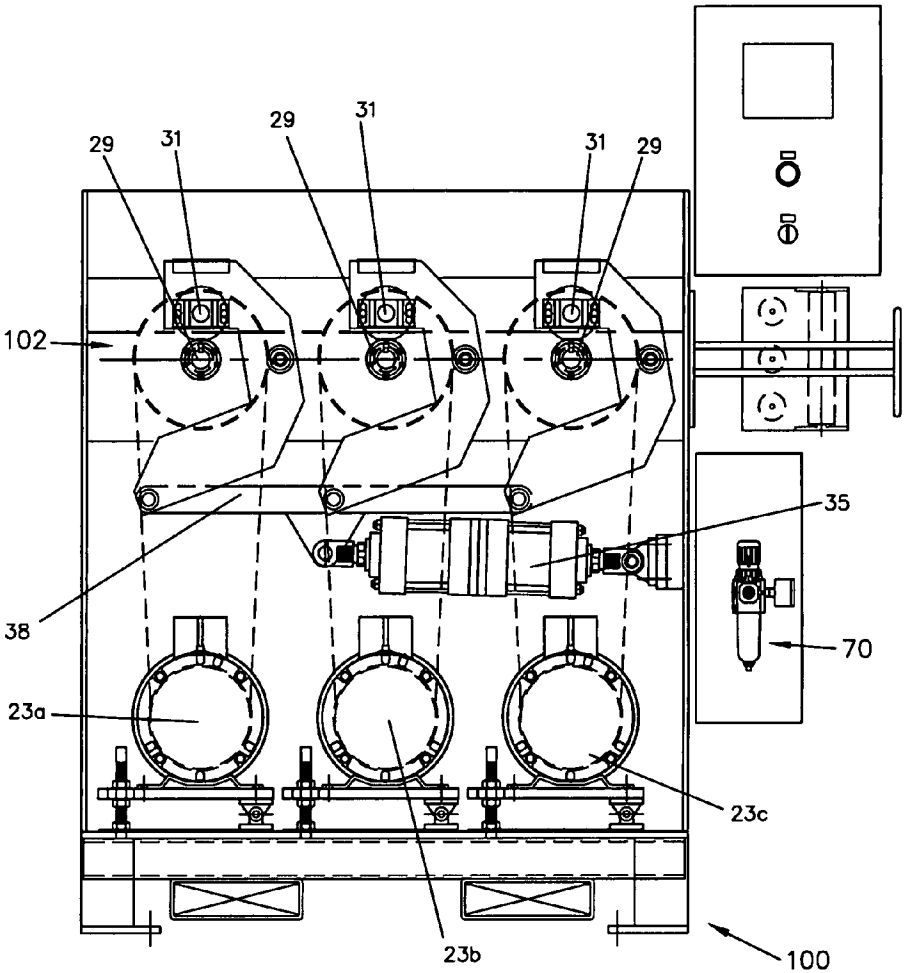
FIG. 6A is a first side perspective view of a wire injector having two wire line paths.
Figure 6B:
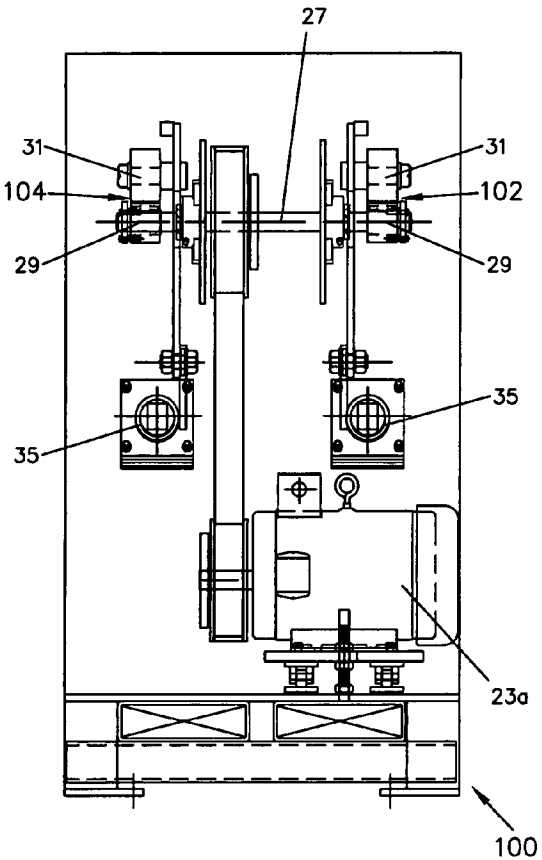
FIG. 6B is a front perspective view of FIG. 6A.

FIGS. 6A and 6B illustrate another embodiment of a wire injector 100 having two wire line paths 102, 104 for impelling two metal wires. FIG. 6A illustrates a side view of the wire injector 100 having three clamps 60 and three upper idler wheels 31 for engaging the metal wire. FIG. 6B illustrates an additional set of clamps 60, upper idler wheels 31 and drive wheels 29 secured at opposing ends of the drive shaft 27.

In addition, a second actuator 35 is provided for controlling the second set of clamps 60 and upper idler wheels 31. It should be appreciated that due to the arrangement of the components of the wire injector 100, each of the motors 23*a*-23*c* rotates drive wheels 29 via each of the drive shafts 27.

Figure 7A:
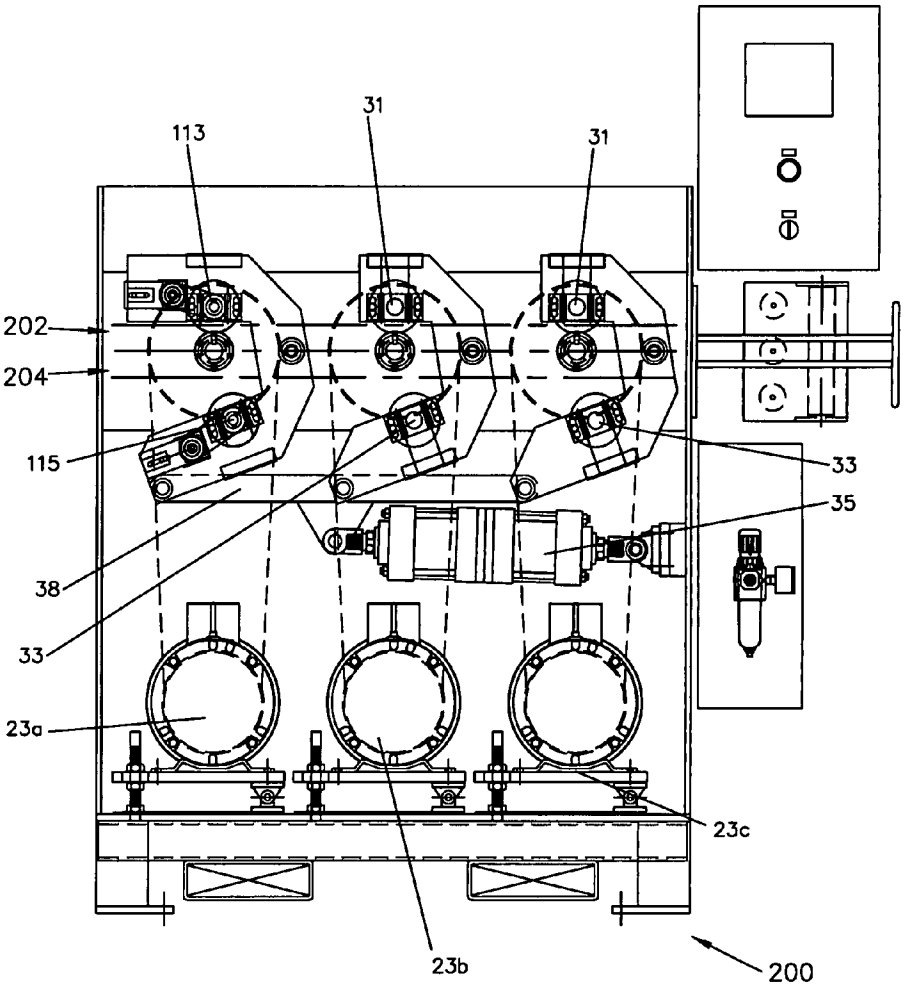
FIG. 7A is a second side perspective view of a wire injector having two additional wire line paths.
Figure 7B:
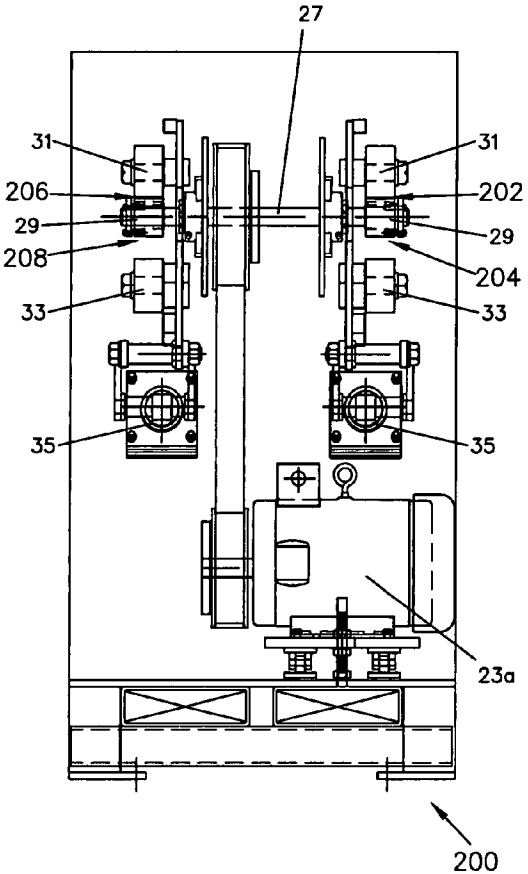
FIG. 7B is a front perspective view of FIG. 7A.

FIGS. 7A and 7B illustrates another embodiment of the present invention. Wire injector 200 impels four metal wires through four wire line paths 202, 204, 206 and 208. Similar to the embodiment illustrated in FIGS. 1A and 1B, the wire injector 200 has the upper idler wheels 31 and the lower idler wheels 33 positioned on each of the clamps 60. The present embodiment has a second set of clamps 60, upper idler wheels 31, lower idler wheels 33 and drive wheels 29. The second set of the clamps 60, idler wheels 31, 33 and the drive wheels 29 are located on an opposite end of the drive shaft 27, as illustrated in FIG. 7B. As shown in FIG. 7B, a first pair of drive wheels 29 are controlled by one motor 23*a*, a second pair of drive wheels 29 are controlled by another motor 23*b*, and a third pair of drive wheels 29 are controlled by another motor 23*c*. Accordingly, two wire line paths for impelling the wire are located on each side of the wire injector 200. It should be appreciated that additional wire line paths for impelling the metal wire are often desirable in the industry since the steel alloy may require multiple metal alloys to be added via the metal wire. Often, due to the size of metal wire reels it is especially desirable to have multiple reels connected to the wire injector 200 to reduce or eliminate the need to disconnect a first type of metal wire and then connect a second type of metal wire.

As previously mentioned, it is typically required in the metal wire industry to accurately measure a length of metal wire prior to injection into a steel ladle. FIG. 7A illustrates an upper counter wheel 113 and a lower counter wheel positioned adjacent to the idler wheels 31, 33, respectively. The counter wheels 113, 115 are connectable to the idler wheels 31, 33 via a pulley assembly or belt assembly. The counter wheels 113, 115 may be connected or in communication with a device for calculating or computing a number of rotations of the counter wheels 113, 115. For example, the counter wheels 113, 115 may be connected to a processing unit to convert a number of rotations to a length of the wire. In an embodiment, the upper idler wheels 31 and the lower idler wheels 33 can function as counter wheels in addition to idler wheels.

Figure 8A:
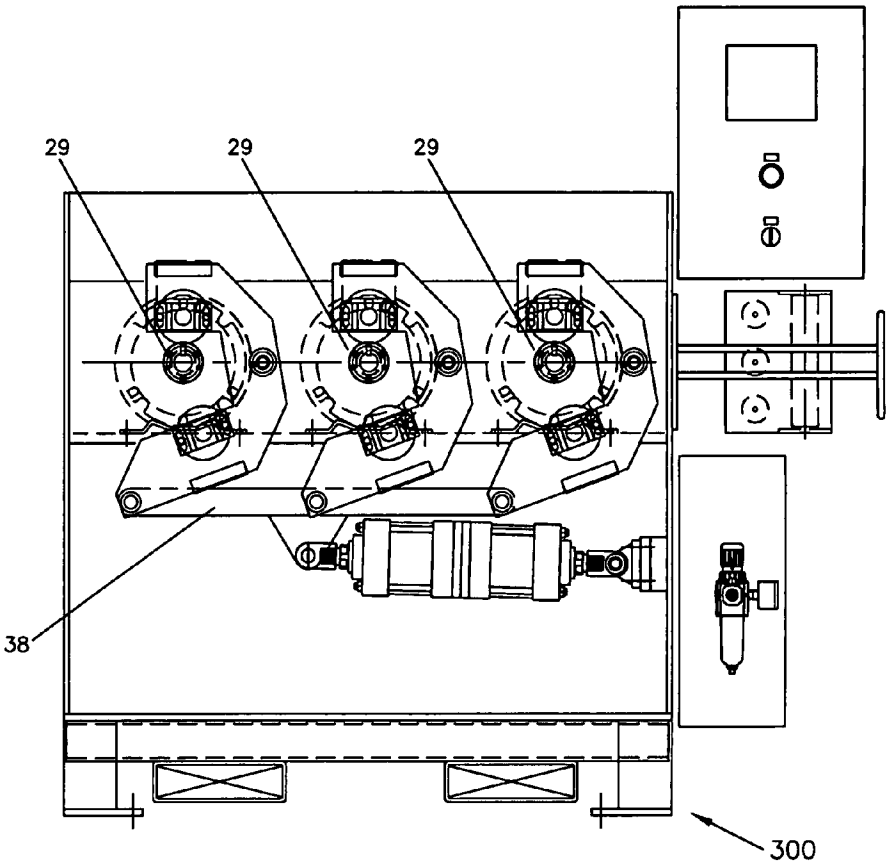
FIG. 8A is a side perspective view of an alternate embodiment of a wire injector having four wire line paths where a motor is directly connected to drive wheels.
Figure 8B:
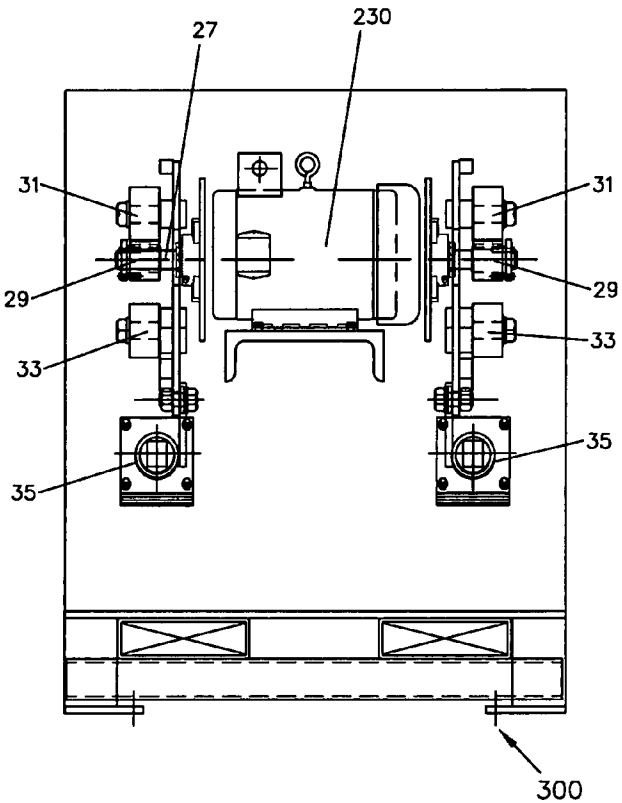
FIG. 8B is a front perspective view of FIG. 8A.

FIGS. 8A and 8B illustrates yet another embodiment of the present invention. The wire injector 300 is capable of impelling four metal wires similar to the embodiment illustrated in FIGS. 7A and 7B. The present embodiment, however, eliminates the first pulley assembly 24*a* (connected to each of the motors 23*a-c*) and the second pulley assembly 24*b* (connected to the drive shaft 27). A motor 230 is directly connected to each of the drive shafts 27 to provide input power directly to the drive wheels 29. It should be noted that it is contemplated that additional sets of clamps 60, idler wheels 31, 33 and/or drive wheels 29 may be positioned on each of the drive shafts 27 of the present embodiment.

Figure 9A:
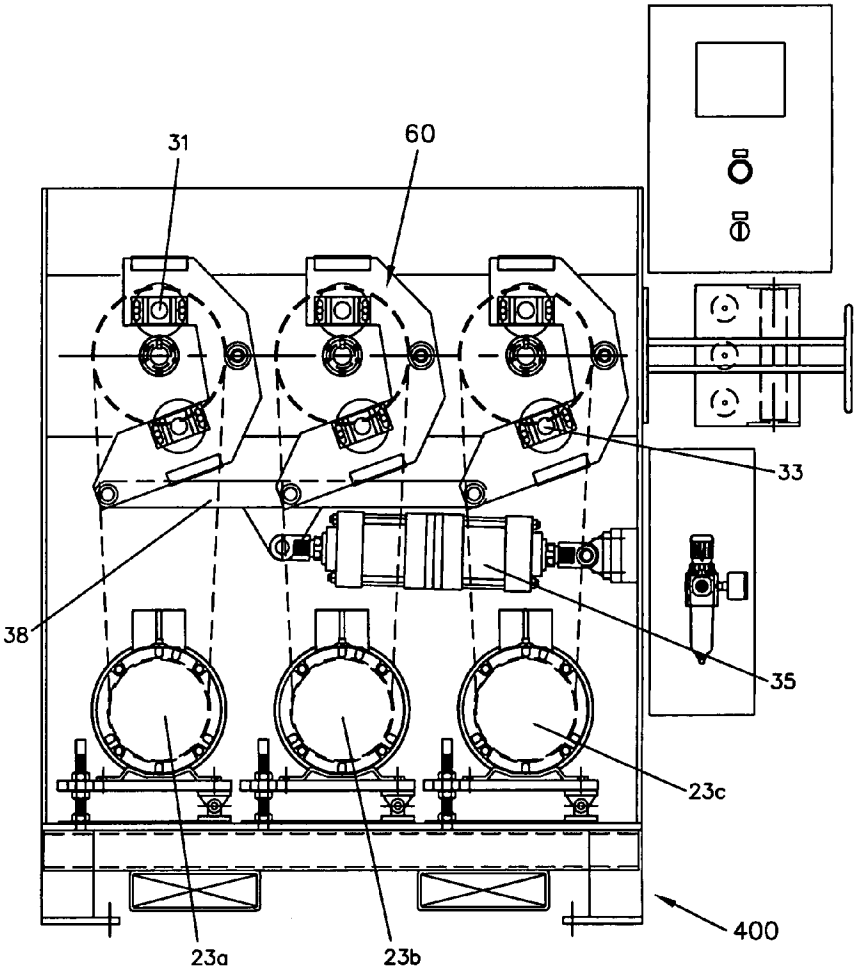
FIG. 9A is a third side perspective view of an alternate embodiment of a wire injector having six wire line paths.
Figure 9B:
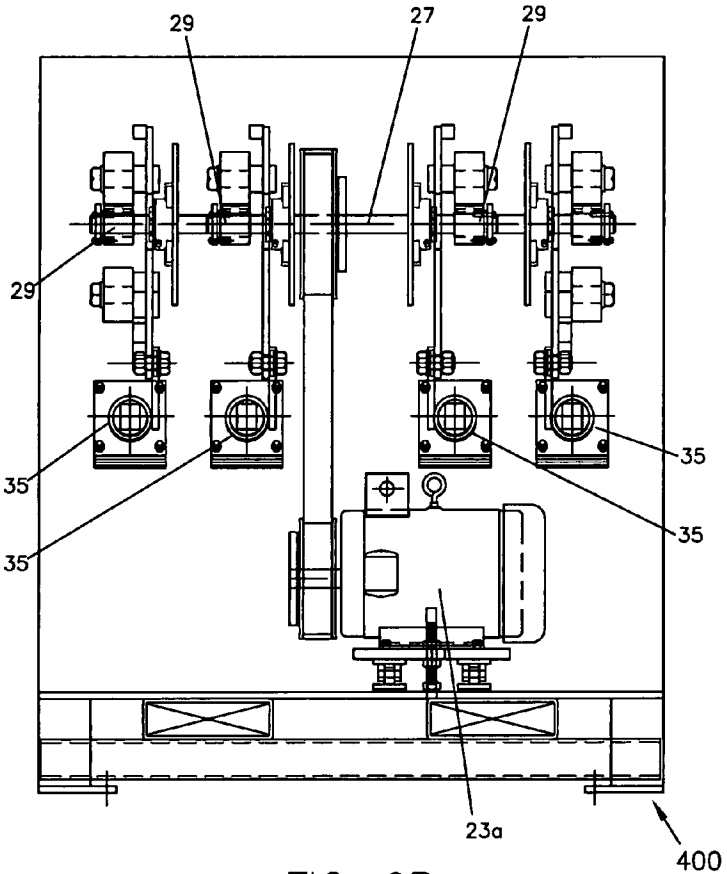
FIG. 9B is a front perspective view of FIG. 9A.

Another embodiment of the invention is illustrated in FIGS. 9A and 9B. The wire injector 400 as shown is a six-path wire injector. That is, the wire injector 400 has six wire line paths for impelling or injecting six metal wires through the wire injector 400. The present embodiment has an additional set of clamps 60, drive wheels 29 and upper idler wheels 31 from the quad-path wire injector shown in FIGS. 7A and 7B. Specifically, the additional set of clamps 60 includes the upper idler wheels 31 to provide an additional wire line path for the wire. Accordingly, the present embodiment has two additional wire line paths from the quad wire injector illustrated in FIGS. 7A and 7B. Similar to previous embodiments, the actuator 35 is connected to each set of clamps 60 via the lever 38.

Figure 10A:
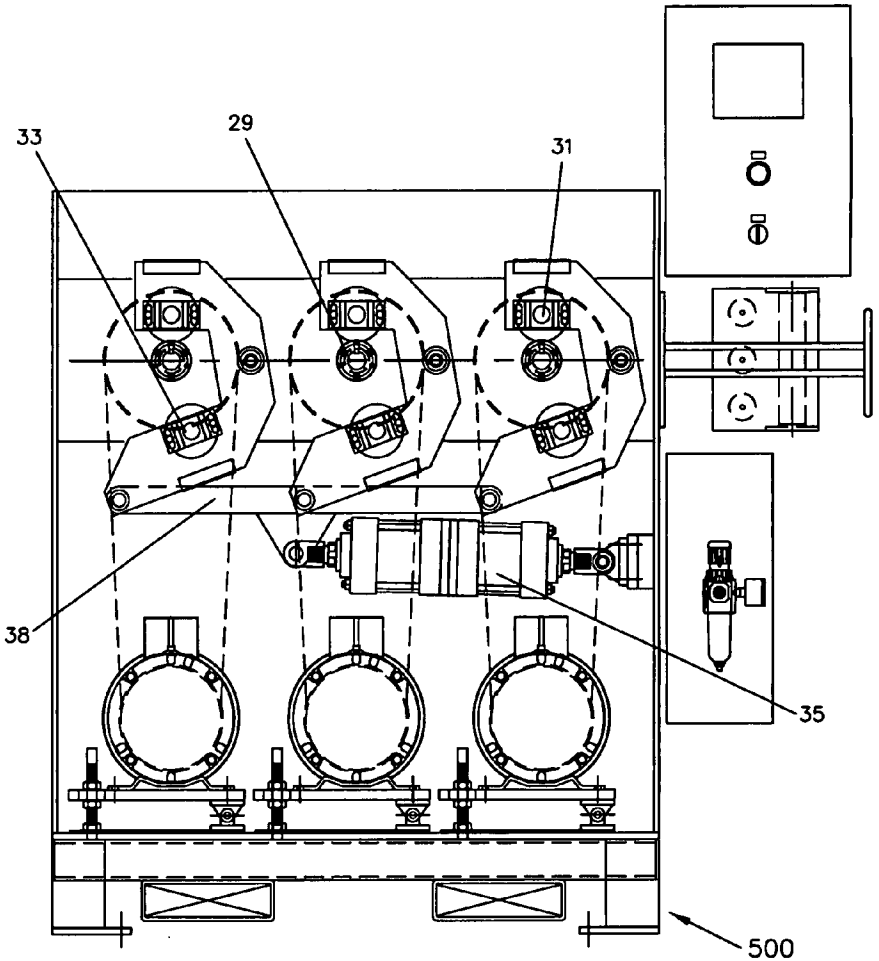
FIG. 10A is a fourth side perspective view of an alternate embodiment of a wire injector having eight wire line paths in an embodiment of the present invention.
Figure 10B:
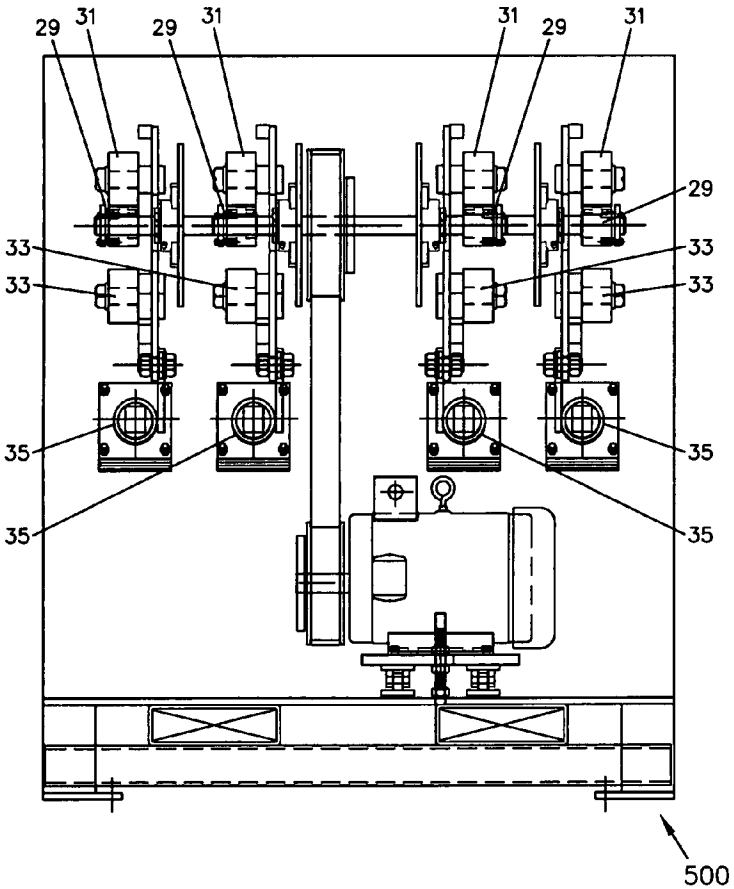
FIG. 10B is a front perspective view of a FIG. 10A.

FIGS. 10A and 10B illustrate another embodiment of the present invention where a wire injector 500 is a eight-path wire injector. The wire injector 500 has an additional set of lower idler wheels 33 from the six-path wire injector shown in FIGS. 9A and 9B. Specifically, the additional set of lower idler wheels 33 provides an additional set of wire line paths for the wire. Similar to previous embodiments, the actuator 35 is connected to each set of clamps 60 via the lever 38.

FIGS. 11A, 11B, 12A and 12B illustrate different vertical arrangements of the six and eight-path wire injectors, respectively, as opposed to the horizontal arrangements of the previous embodiments of the wire injectors 400 and 500 shown in FIGS. 9A and 10A.

Figure 11A:
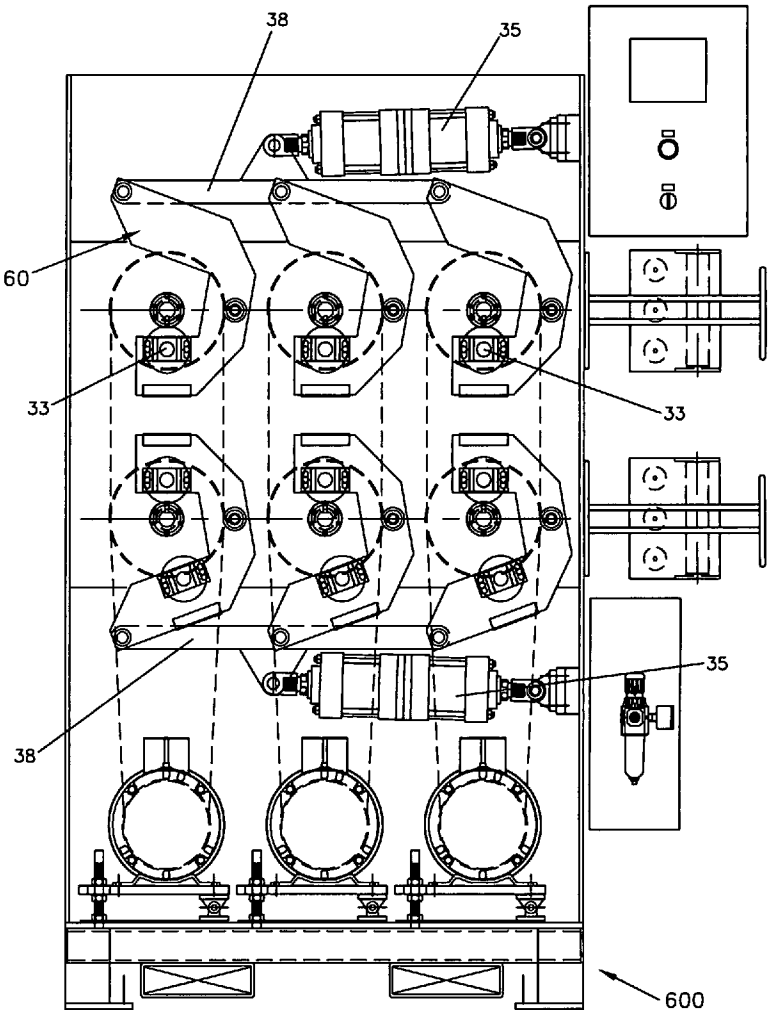
FIG. 11A is a side perspective view of an alternate configuration of a wire injector having six wire line paths.
Figure 11B:
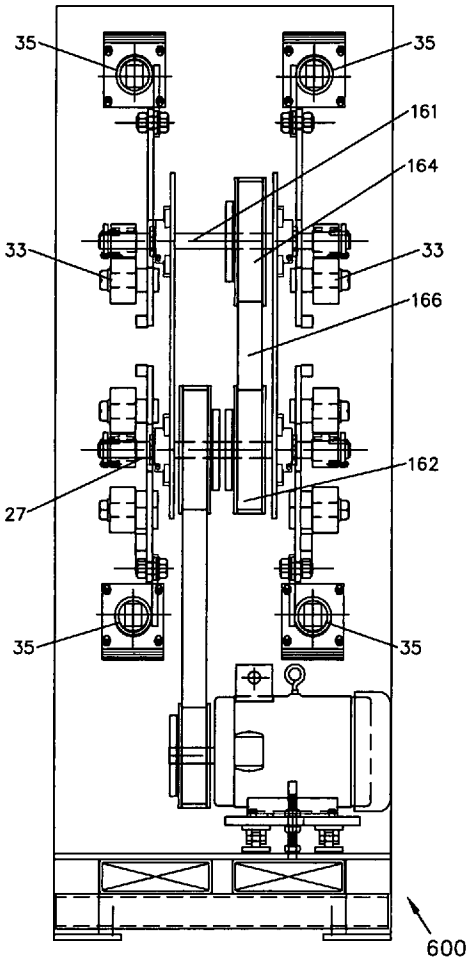
FIG. 11B is a front perspective view of FIG. 11A.

FIGS. 11A and 11B illustrate a six-path wire injector 600 having a vertical configuration. Specifically, the drive shaft 27 merely has two of the clamps 60 attached at opposing ends. Instead of securing additional clamps 60 to the drive shaft 27, an additional drive shaft 161 is provided. The additional drive shaft 161 is positioned above the drive shaft 27 of the previous embodiments. The drive shaft 161 is located between a top of the wire injector 600 and the drive shaft 27 such that the width of the apparatus can be limited to a similar width as the quad-path wire injector 200, shown in FIGS. 7A and 7B. Further, the wire injector 600 has a third pulley assembly 162 and a fourth pulley assembly 164 that are connected by a belt 166. The third pulley assembly 162 engages the drive shaft 27 for transferring power to the fourth pulley assembly 164. In turn, the fourth pulley assembly 164 transfers the input power to the additional drive shaft 161.

Figure 12A:
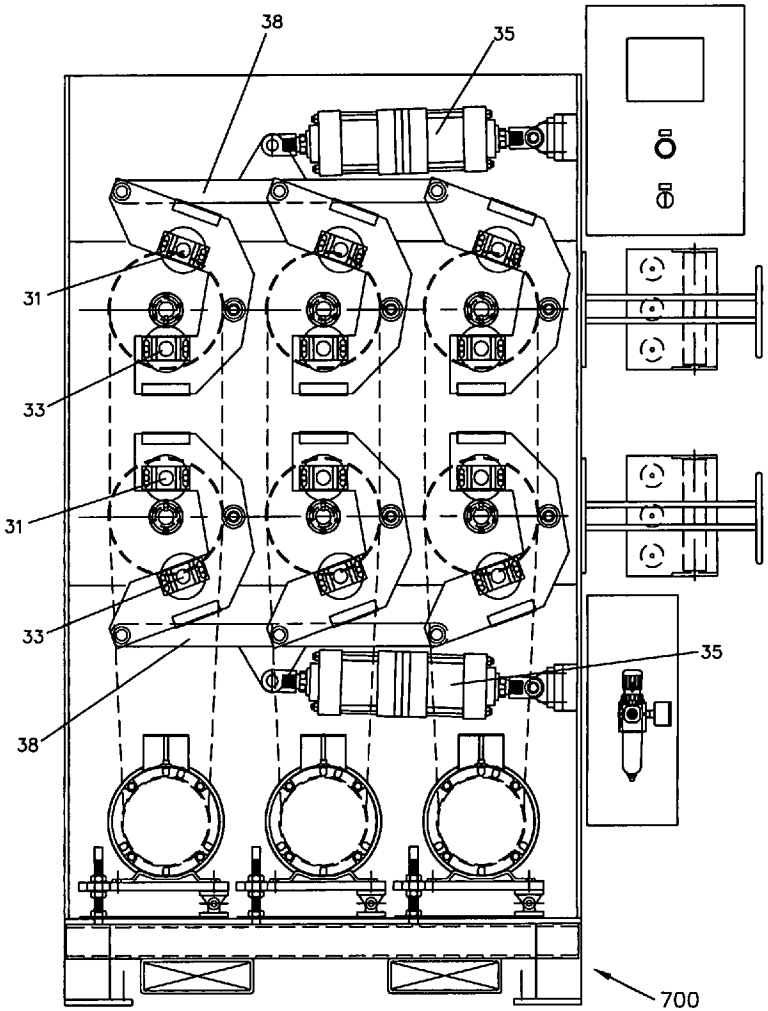
FIG. 12A is a side perspective view of an alternate configuration of a wire injector having eight wire line paths in an embodiment of the present invention.
Figure 12B:
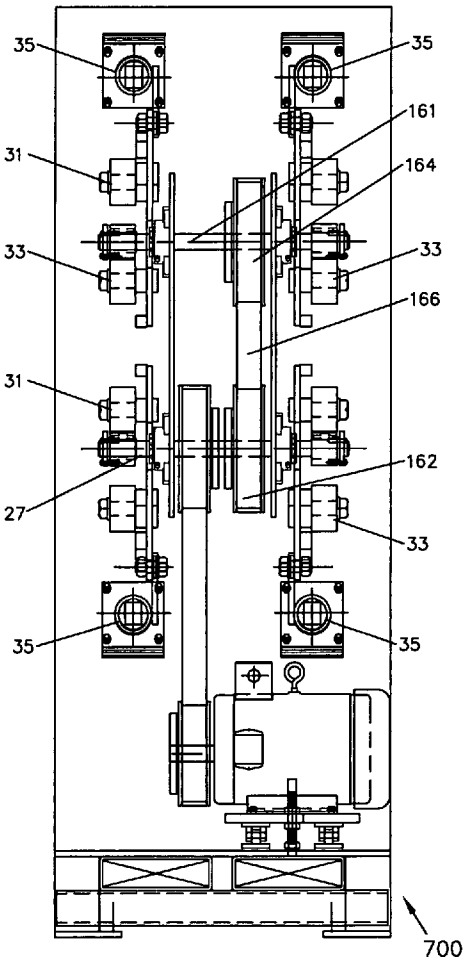
FIG. 12B is a front perspective view of FIG. 12A.

Although only the lower idler wheels 33 are connected to the additional drive shaft 161, it is contemplated that the upper idler wheels 31 are connectable to the clamps 60 of the additional drive shaft 161. FIGS. 12A and 12B illustrate such an embodiment as the wire injector 700 is an eight-path wire injector having a vertical configuration.

In view of the embodiments illustrated, one of ordinary skill in the art will appreciate that the present invention can be customized by constructing a wire injector having any number of paths in various different orientations. In addition, the width and height can be adjusted to size by utilizing the vertical configuration, the horizontal configuration or a combination of those configurations. While the present invention is described with reference to several embodiments of the invention, nothing in the specification should be interpreted to limit this invention to any particular embodiment or any common characteristic except as explicitly recited in the appended claims.

What is claimed is:

1. A wire injector apparatus comprising:

a first wire path and a second wire path adjacent to said first wire path;

a drive wheel impelling a wire in said first wire path or said second wire path;

a first idler wheel engagable with said wire in said first wire path; and a second idler wheel engagable with said wire in said second wire path;

an actuator engaging said first idler wheel and said second idler wheel, said actuator engaging at least one of said first idler wheel with said first wire path and said second idler wheel with said second wire path or disengaging both said first idler wheel and said second idler wheel; and a clamp pivotally connected to said actuator, said clamp having said first idler wheel positioned on a first opposing end and said second idler wheel positioned on a second opposing end.

2. The wire injector apparatus of claim 1, further comprising a lever interposed between said clamp and said actuator, said lever pivotally connected to said clamp and said actuator.

3. The wire injector apparatus of claim 2, wherein said actuator comprises a pneumatic cylinder engaging said clamp and said lever.

4. The wire injector apparatus of claim 1, wherein said clamp is generally C-shaped and pivotable about a point intermediate to said opposing ends of said clamp.

5. The wire injector apparatus of claim 1, further comprising a motor providing power to a drive shaft that is translated into rotation of said drive wheel.

6. The wire injector apparatus of claim 5, further comprising a belt engaging said drive shaft and said drive wheel.

7. The wire injector apparatus of claim 5, wherein said drive shaft rotatably connects said drive wheel to said motor.

8. A metal wire injector for providing at least one length of metal wire comprising:

a motor;

a drive wheel engaged to said motor, wherein operation of said motor rotates said drive wheel and said drive wheel impels said metal wire;

a plurality of pivotable clamps, each of said clamps includes an upper idler wheel and a lower idler wheel positioned at respective opposing ends of each of said clamps; and a pneumatic actuator connected to said clamps to move said clamps to a first position where said upper idler wheels engage said metal wire, a second position where said lower idlers wheels engage said metal wire, and a third position where said upper idler wheels and said lower idler wheels do not engage said metal wire.

9. The metal wire injector of claim 8, wherein said clamps are generally C-shaped.

10. The metal wire injector of claim 8, wherein said upper idler wheels engage a first metal wire in said first position and said lower idler wheels engage a second metal wire in said second position.

11. The metal wire injector of claim 8, wherein said pneumatic actuator engages said clamps to a first wire path and a second wire path.

12. The metal wire injector of claim 11, further comprising a second pneumatic actuator connected to a plurality of said clamps, said second actuator engages said clamps to a third wire path and a fourth wire path.

13. The metal wire injector of claim 12, further comprising a third pneumatic actuator connected to a plurality of said clamps, said third pneumatic actuator engages said clamps to a fifth wire path and a sixth wire path.

14. The metal wire injector of claim 13, wherein said first and said second wire paths are adjacent to said third and said fourth wire paths, and further wherein said fifth and said sixth wire paths are adjacent to said first and said second wire paths and opposite said third and said fourth wire paths.

15. The metal wire injector of claim 13, wherein said fifth and said sixth wire paths are positioned above said first, said second, said third and said fourth wire paths.

16. The wire injector of claim 13, further comprising a fourth pneumatic actuator connected to a plurality of said clamps, said fourth pneumatic actuator engages said clamps to a seventh wire path and a eighth wire path.

17. The wire injector of claim 16, wherein said seventh and said eighth wire paths are adjacent to said third and said fourth wire paths, wherein said first and said second wire paths are adjacent to said third and said fourth wire paths and opposite to said seventh and said eighth wire paths, and further wherein said fifth and said sixth wire paths are adjacent to said first and said second wire paths and opposite to said third and said fourth wire paths.

18. The wire injector of claim 16, wherein said seventh and said eighth wire paths are positioned above said first, said second, said third, said fourth, said fifth and said sixth wire paths.

* * * * *